United States Patent [19]

Muderlak

[11] 4,322,904

[45] Apr. 6, 1982

[54] INDICIA DISPLAY DEVICE

[75] Inventor: Kenneth J. Muderlak, Shorewood, Wis.

[73] Assignee: KCS Industries, Inc., Milwaukee, Wis.

[21] Appl. No.: 106,002

[22] Filed: Dec. 21, 1979

[51] Int. Cl.[3] ..... G09F 11/04; G09D 3/08

[52] U.S. Cl. ..... 40/495; 40/113

[58] Field of Search ..... 40/488, 491, 495, 111, 40/113, 502; 273/142 H

[56] References Cited

U.S. PATENT DOCUMENTS

| | | | |
|---|---|---|---|
| 1,670,159 | 5/1928 | Maxon | 40/495 |
| 1,779,684 | 10/1930 | Van Sicklen, Jr. | 40/495 |
| 1,804,260 | 5/1931 | Kerr | 40/495 X |
| 2,090,998 | 8/1937 | Gessler | 40/495 X |
| 2,728,167 | 12/1955 | Knott | 40/495 X |
| 2,959,872 | 11/1960 | Rodgers | 40/495 X |
| 3,057,323 | 10/1962 | Gomi | 40/491 X |
| 3,094,801 | 6/1963 | Becker | 40/495 |
| 3,628,270 | 12/1971 | Fleming | 40/113 |

*Primary Examiner*—F. Barry Shay
*Assistant Examiner*—G. Lee Skillington
*Attorney, Agent, or Firm*—Andrus, Sceales, Starke & Sawall

[57] ABSTRACT

An indicia display device including an outer casing having at least one opening or window. A non-planar guideway is provided within the casing and a sheet of flexible material is mounted for rotation within the guideway and conforms to the non-planar configuration of the guideway. The sheet carries indicia, such as numerals, words, or the like, which is disposed in a generally circular pattern about the axis of rotation of the sheet, and the window is located in alignment with the pattern of indicia. By rotating the sheet within the guideway, the indicia can be successively exposed through the window to the viewer.

25 Claims, 11 Drawing Figures

FIG. 3
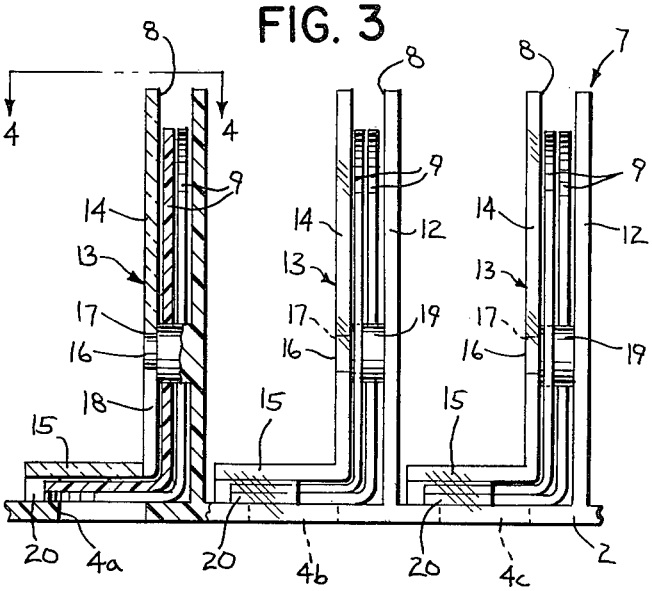
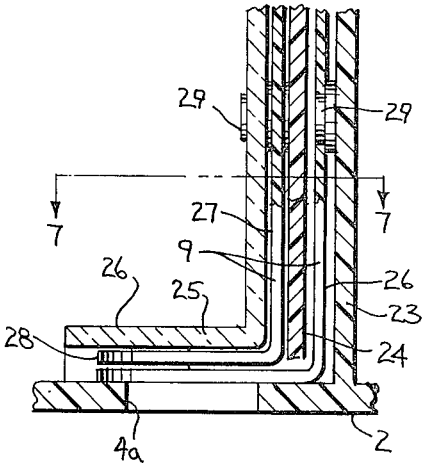
FIG. 6
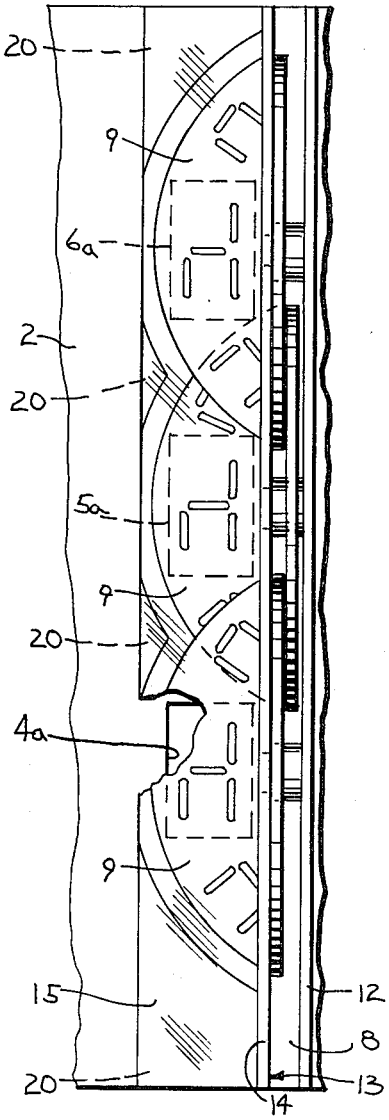
FIG. 4
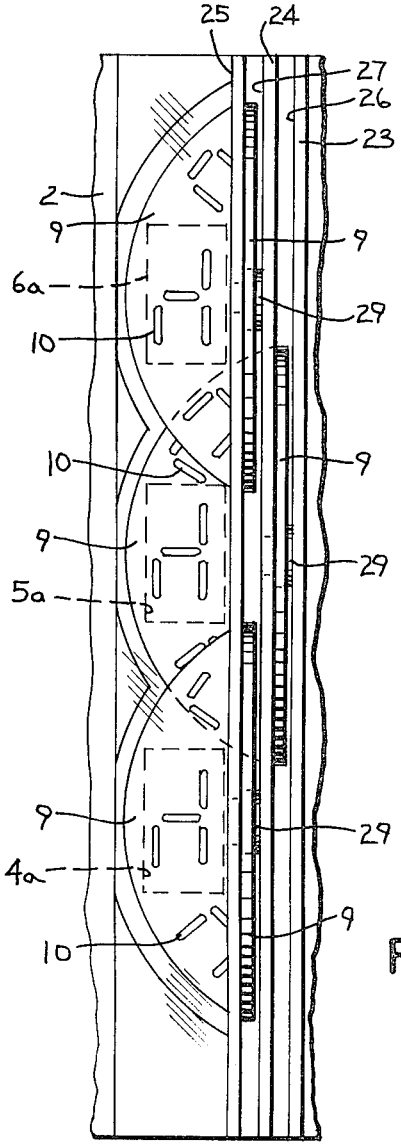
FIG. 7

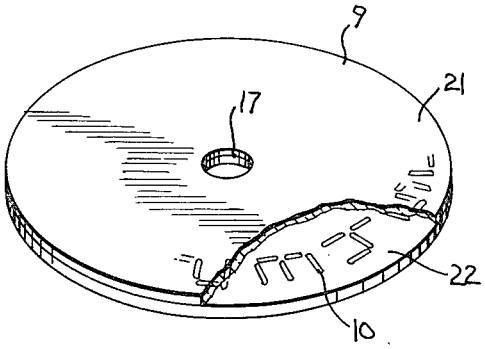
FIG. 5
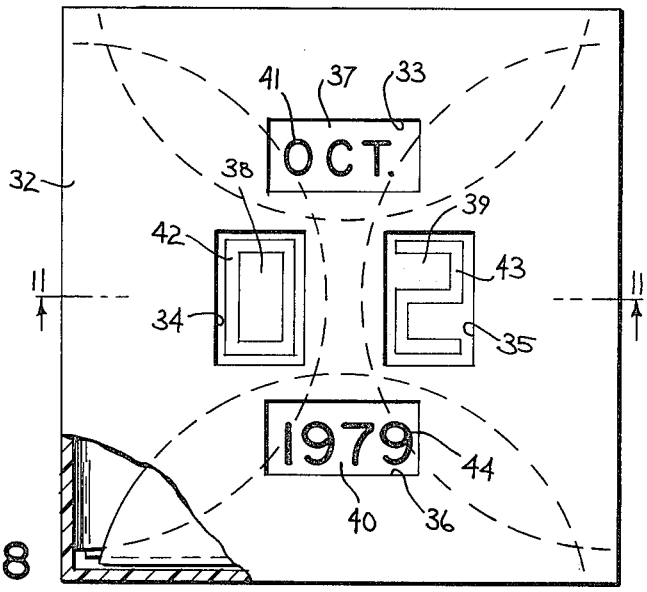
FIG. 8
FIG. 9
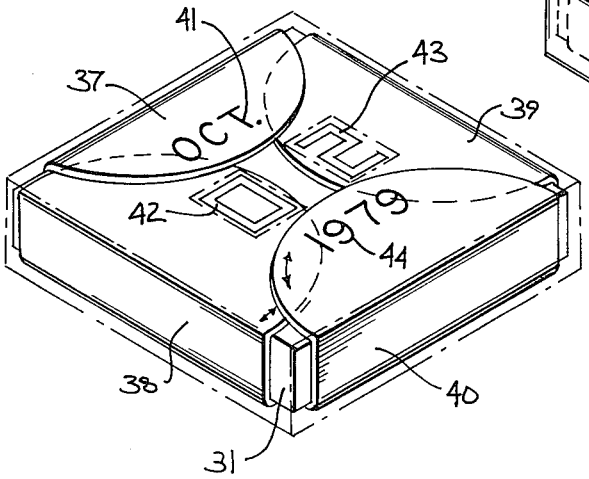
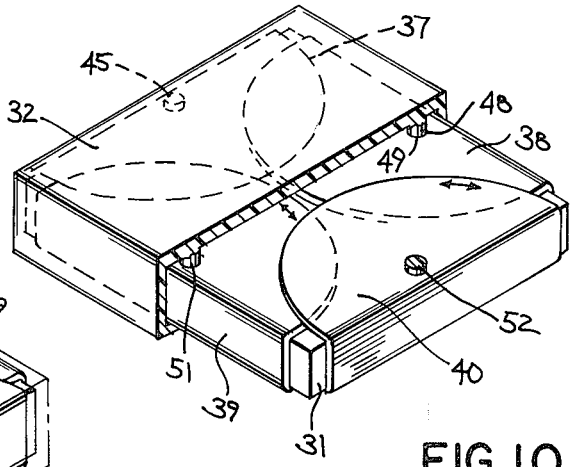
FIG. 10
FIG. 11
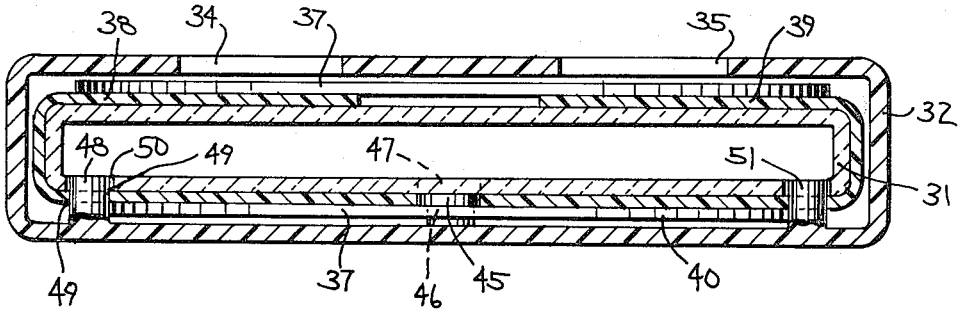

INDICIA DISPLAY DEVICE

BACKGROUND OF THE INVENTION

Pricing boards are commonly used in restaurants, cafeterias, liquor stores, and the like to indicate prices of various products. As the prices may change frequently, it is necessary to reflect the price changes on the pricing board.

One common form of pricing board utilizes fonts, which are individual letters or numerals, having tabs or projections which can be inserted within grooves in the pricing board. With this type of pricing board, a large inventory of fonts is required and frequently the fonts are misplaced or damaged. In addition, a substantial amounts of time is required to individually remove each font from the board, replace the font in the storage container, select the new font and insert it onto the pricing board.

More recently, pricing boards have been constructed with a series of windows or openings and a rotatable drum bearing numerals or indicia is mounted for rotation behind each window. By manually inserting the finger through the window, the drum can be rotated to expose the desired indicia in the window. While the use of the rotating drum simplifies the changing of prices, the drums are relatively expensive, due to the fact that they are normally formed of injection molded plastic. Furthermore, it is costly to apply the indicia to the curved outer periphery of each drum.

As a further disadvantage, the rotary drum-type of indicia display cannot satsifactorily be illuminated from the rear, and as the indicia is located on a curved surface, it may, depending on the radius of curvature, appear somewhat distorted to the viewer. In addition, each rotary drum is required to have some type of friction brake mechanism to hold the drum in position and prevent free rotation. As a further drawback, a substantial depth of casing or enclosure is required for housing the drums, and thus the rotary drum type of display is not acceptable in certain installations which require a minimum depth.

More recently, flexible, stressed polyester tape has been used in pricing boards and similar types of displays. In this construction, the tape is stressed so that it is pre-coiled and the ends of the tape are maintained in the coiled condition without the need of a spindle or axle. The tape bearing the indicia is fed through a guideway and exposed through a window in the casing. As in the case of the drum type, the prices are changed by inserting the finger through the window and manually moving the tape to expose the desired indicia.

The pre-stressed tape system is relatively expensive for it requires an individual tape to be located behind each window in the pricing board. Furthermore, as the tape is not maintained on a spindle, but is freely coiled, it has a tendency to kink as it is pushed by the finger, with the result that permanent kinks or deformities can destroy the reliability of the unit.

With the pre-stressed tape it is not practical to form a laminated sandwich tape structure. Thus, the printed indicia is exposed on one surface of the tape, with the result that the printing is invariably scratched or marred with use, as it is pushed back and forth by the user.

As the pre-stressed tape is not in an endless form, at times, it is necessary that the entire tape be reversed to obtain the desired numeral, or other indicia in the viewing window. To prevent the tape from being pushed completely out of the guideways, it has been necessary to put a warning such as "stop" at the ends of the tape, and this increases the length of the tape that is required and the overall cost of the unit.

As a further disadvantage, the pre-stressed tape system tends to bind when pushed through the guideway with the result that it is often necessary to apply a powdered lubricant in order to facilitate movement of the tape.

As the coiled ends of the tape project rearwardly a substantial distance beyond the portion of the tape which is being viewed through the window, the coiled ends provide an obstruction to direct illumination of the exposed indicia.

In addition to the mechanical forms previously described, electronic pricing boards have also been used. However, electronic systems are very expensive and thus do not normally lend themselves to use in restaurants, liquor stores, and the like.

SUMMARY OF THE INVENTION

The invention is directed to an improved inexpensive and reliable indicia display device, to be used in a pricing board, calendar, or the like. The device includes an outer casing or enclosure having one or more viewing windows or openings in one wall through which indicia is exposed. A non-planar guideway is formed within the casing, and a disc-like sheet of flexible material is disposed within the guideway and conforms to the non-planar configuration of the guideway. The sheet carries indicia, such as numerals, words, or the like, which is located in a generally circular pattern about the axis of rotation of the sheet and the window is disposed in alignment with the pattern of indicia. By inserting a finger through the viewing window the sheet can be rotated within the guideway to expose the desired indicia to the viewer.

The indicia display device of the invention is relatively inexpensive and has the advantage of being capable of being fabricated by a single industrial source. The device is easy to operate and extremely reliable, for it includes only a single moving part, which is the rotatable disc of flexible plastic film.

As the guideways for the flexible discs and other internal components are preferably made of transparent or translucent materials, the portions of the discs exposed within the openings or windows can be brilliantly and uniformly illuminated by lighting located within the casing. In the event that the device is to be non-illuminated, the depth of the casing can be substantially reduced over similar types of conventional displays.

As the portion of the disc exposed within the viewing window is in a flat planar condition, the indicia will not be distorted and can be more easily read than indicia which lies on a curved viewing surface.

The device of the invention permits relatively large indicia to be located in viewing windows immediately adjacent each other and yet provides an enclosure of minimum dimensions.

Other objects and advantages will appear in the course of the following description.

DESCRIPTION OF THE DRAWINGS

The drawings illustrate the best mode presently contemplated of carrying out the invention.

In the drawings:

FIG. 3 is a horizontal section showing the mounting of the flexible discs;

FIG. 4 is a view taken along line 4—4 of FIG. 3;

FIG. 5 is a perspective view of the disc in the flat, non-deformed condition with parts broken away;

FIG. 6 is a view similar to FIG. 3 showing an alternate form of the invention;

FIG. 7 is a section taken along line 7—7 of FIG. 6;

FIG. 8 is a front elevation of a modified form of the invention, as can be used for a calendar;

FIG. 9 is a perspective view of the front of the device shown in FIG. 8, with the cover removed;

FIG. 10 is a perspective rear view of the device shown in FIG. 9 with the cover broken away; and FIG. 11 is a section taken along line 11—11 of FIG. 8.

DESCRIPTION OF THE PREFERRED EMBODIMENT

Figure 1:
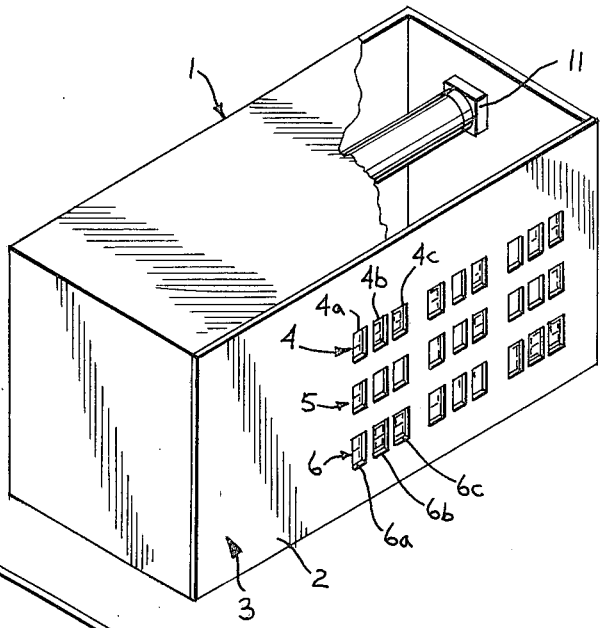
FIG. 1 is a perspective view of an illuminated pricing board incorporating the invention.

FIG. 1 illustrates an indicia display device having particular use as a pricing board. The device is composed of a casing or enclosure 1 including a front wall 2 having an area, indicated generally by 3, for listing various products or items to be sold. In addition, the front wall 2 is provided with three rows of windows or openings 4, 5, and 6, and indicia, in the form of numerals, is visible through each window to indicate the price of the item shown to the left of the windows. For example, the group of three upper windows 4*a*–4*c*, in combination, will designate a price in dollars and cents.

In accordance with the invention a plurality of rotating, indicia bearing units, are located within the casing behind each of the windows 4–6. One such unit 7 is associated with the windows 4*a–c*, 5*a–c*, and 6*a–c*, and will be described in detail. The other units 7 are structurally the same as those hereinafter described.

Each indicia bearing unit 7 includes three generally L-shaped guideways 8 composed of a pair of sections which are disposed at approximately 90° with respect to each other. Three flexible, transparent discs 9 are mounted for rotation within each of the guideways 8. The discs 9 bear indicia 10 which, as shown in the drawings, constitute the digits 0–9, which are arranged in a circular pattern on the peripheral portion of each disc 9. One of the digits 10 on each disc 9 is exposed through the respective windows 4–6.

To illuminate the indicia which is exposed within the windows, an illuminating device 11, such as a fluorescent light bulb, can be mounted within the casing 1.

Each guideway is composed of a fixed guide member 12 which is attached to the front wall 2 and extends rearwardly from the front wall. As best shown in FIG. 3, the guide members 12 are disposed in spaced parallel relation. In addition, each guideway 8 is defined by a generally L-shaped guide member 13 composed of a leg 14, which is located parallel to the respective guide member 12, and a second leg 15, which is disposed normal to leg 14 and is positioned parallel to the front wall 2. For effective illumination, the guide member 12 and 13 is preferably formed of transparent or translucent materials, such as plastic or glass.

Figure 2:
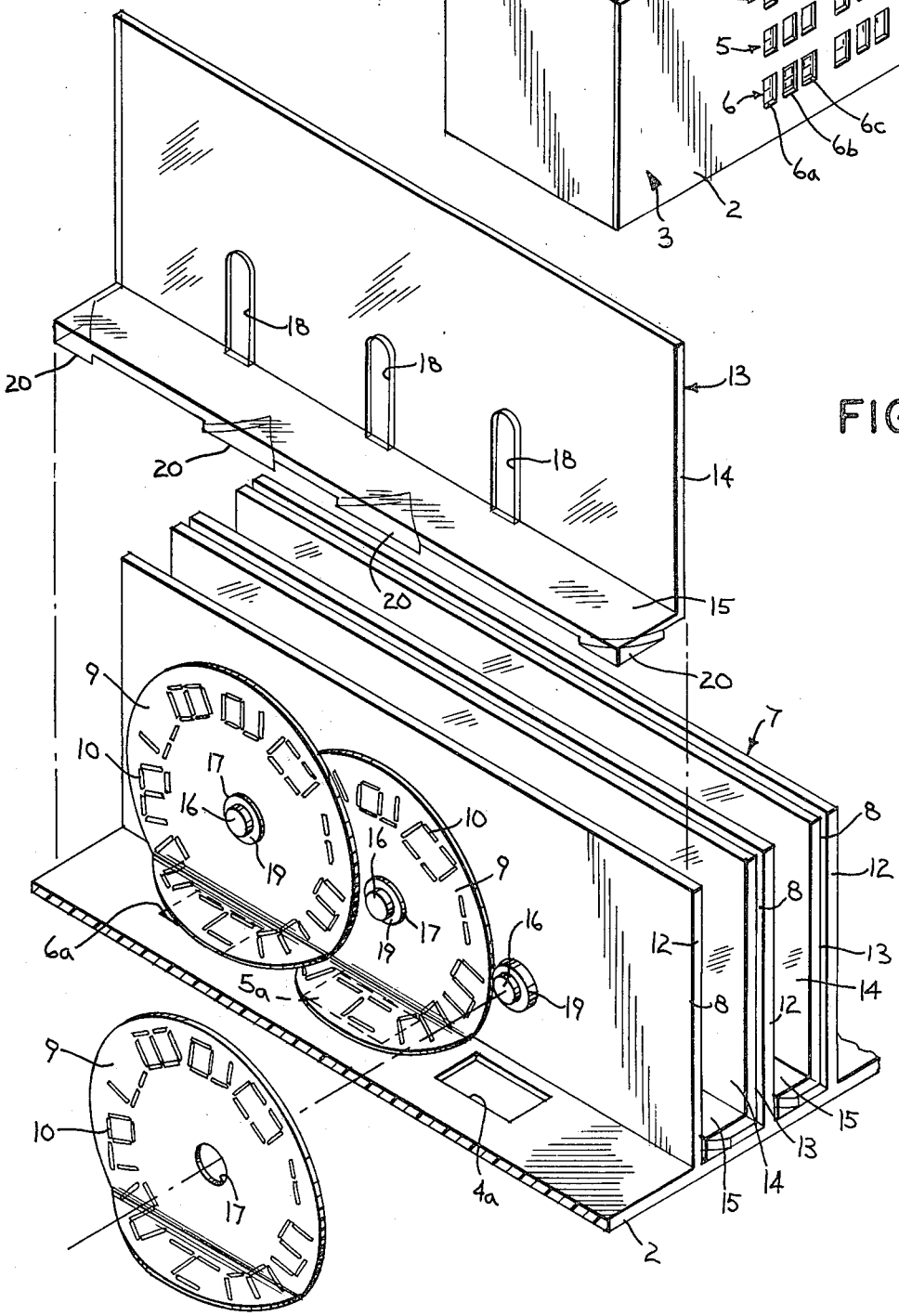
FIG. 2 is a perspective view showing the manner in which the indicia-bearing, flexible discs are mounted within the casing.

As best illustrated in FIG. 3, the flexible transparent discs 9 conform to the configuration or the guideways and have a generally L-shape. The discs 9 are mounted for rotation within the respective guideways 8 and, as best illustrated in FIG. 2, each guide member 12 is provided with three pins 16 which extend laterally through openings 17 in the respective discs 9, and the outer ends of the pins 16 are received within elongated vertical slots 18 formed in the respective guide members 13. To provide uniform spacing between the guide members 12 and the respective legs 14, the pins 16 are formed with enlarged shoulders 19 which bear against the surface of the leg 14 of guide member 13. In addition, the leg 15 of each guide member 13 is spaced from the front wall 2 by a series of curved spacers 20 or abutments which are formed on the outer surface of each leg 15 and are located outwardly of the discs 9. The spacers 20 serve to space the legs 15 from the front wall 2, and due to their curved configuration, will not interfere with rotation of the discs 9 within the guideways 8.

As best illustrated in FIG. 4, the outer discs 9 associated with each guideway 8 overlap the central disc and the amount of overlap can be slightly less than the distance between adjacent pins 16 so that the overlapping discs will not interfere with the axes of rotation of the discs.

The ends of the guide members 13 can be locked to the walls of the casing 1 by any convenient method, such as mechanical fasteners, adhesives, or the like.

As illustrated in FIG. 4, the numerals 10 on the flexible discs 9 are visible through the windows 4–6 in the front wall 2, and by manually inserting a finger into the window and pushing, the individual discs can be rotated about their respective axes to thereby expose the desired numeral or indicia through the window or opening. The discs are made of flexible plastic film, such as polyester film, having a thickness generally in the range of 1 to 6 mils. Due to its flexible nature, the disc can be rotated about its axis even though the disc is in a generally L-shaped configuration, as shown in FIG. 3.

The frictional resitance to rotating the disc 9 within the guideway 8 can be varied by varying the radius of the curve or bend in the guideway. By increasing the radius, the frictional resistance to rotation will be reduced. The frictional resistance can also be varied by varying the thickness of the disc 9, or by varying the depth of the spacers 19 and 20 between the guide members 12 and 13 which define the guideway.

While FIGS. 1–5 have illustrated the invention, as used with a pricing board, in which case the indicia 10 would constitute the digits 0–9, the invention can be used for various types of displays and various indicia can be employed, as for example, words, pictures, colors, fabrics, and the like, depending on the particular use of the display device. Moreover, it is comtemplated that one or more windows or openings can be utilized depending upon the nature of the display device.

Each of the flexible discs 9 is preferably formed of a sandwich construction, including two layers of transparent plastic film 21 and 22, which are joined together by a suitable adhesive. Preferably, the inner surface of one of the two layers 21 and 22 is printed with the desired indicia 10 and in this manner the indicia is not exposed, so that it will not be scratched or marred as the disc 9 is manually rotated within the respective guideways 8.

While the drawings have illustrated the discs 9 being journalled or mounted for rotation about the pins 16, it is contemplated that the discs can be mounted for rotation in other manners, as for example, by having outer guide members which confine the disc and guide it in rotation.

Similarly, while the discs 9 are shown in circular form, the discs can take various configurations, such as oval, polygonal, or the like.

FIGS. 6 and 7, illustrate a modified form of the invention, in which a series of discs 9 are associated with each guideway but the discs are spaced from each other so that they do not rotate in contact with each other. More specifically, the embodiment includes a series of spaced parallel guide members 23 that extend inwardly from front wall 2 and which correspond generally to the guide members 12. A second guide member 24 is mounted in spaced relation to each guide member 23, while a third L-shaped guide member 25 is spaced from the guide member 24. The space between guide members 23 and 24 defines a guideway 26 and the space between the guide members 24 and 25 defines a parallel guideway 27. In addition, the portion of guide member 25 which is parallel to wall 2 defines a guideway 28 with the wall. The two outer discs in the row, as shown in FIG. 7, are mounted for rotation on pins or shafts 29 within the connecting guideways 27 and 28, while the central disc 9 in the row is mounted for rotation on a similar pin or shaft 29 within the guideways 26 and 28. Pins 29 are each provided with a pair of shoulders to maintain the spacing of the guide members 24, 25 and 26.

With this construction, the two outer discs 9 in the row are mounted for rotation within one of the guideways 27, while the central disc is mounted for rotation within the other of the guideways 26, thereby minimizing the direct contact between adjacent discs.

FIGS. 8–11 illustrate the invention as used to provide a calendar 30. The calendar includes a central, generally rectangular base or core 31, and an outer casing 32 which encloses all six faces of the base 31. The surfaces of the outer casing 32 are spaced from the corresponding surfaces of the base 31 to provide guideways. The casing can be formed in two or more sections which can be secured together by adhesives, heat fusing, mechanical fasteners, or the like.

As illustrated in FIG. 8, the outer casing 32 is provided with four windows or openings 33–36, and a series of flexible, indicia-bearing discs 37–40, similar in structure to discs 9, are mounted for rotation within the guideway between the base 31 and outer casing 32 in a manner such that the indicia on the discs is exposed through the respective windows 33–36. More specifically, the disc 37 includes, as indicia 41, the months of the year, which are exposed through the window 33. The discs 38 and 39 bear digits or numerals 42 and 43 which are exposed through the respective windows 34 and 35, while the disc 40 bears a number of calendar years, indicated by 44, and the years are exposed through the window 36.

FIGS. 8 and 9 illustrate the device with the cover removed. The disc 37 is folded around an end of the base 31 as illustrated in FIG. 8, and is mounted for rotation within the space or guideway between the outer cover 32 and base 31 by a pin or shaft 45, which is formed integrally or attached to the inner surface of the cover 32 and extends through an opening 46 in the disc and is received within a hole or recess 47 in the base 31. As contained within the guideway, the disc 37 has a generally U-shaped cross sectional configuration. By inserting the finger through the window 33, the disc can be rotated about the pin 45 to expose the various indicia 41 within the window.

Disc 38 is folded around the side of the core 31, and in the folded condition, also has a generally U-shape. As in the case of disc 37, the disc 38 is mounted for rotation within the guideway by means of pin 48 which is attached to the inner surface of cover 32 and extends through an opening 49 in the disc and is received within a suitable hole or recess 50 in the core 31.

Discs 39 and 40 are similarly disposed within the space or guideway between the cover 32 and the core 31, and are mounted for rotation about pins 51 and 52, which are similar in construction to pin 45. As in the case of the discs 37 and 38, the discs 39 and 40 are folded over opposite ends of the core and have a generally U-shaped configuration.

As the discs 37 and 40 partially overlap the discs 38 and 39, it is preferred that the discs 37 and 40 be formed of an opaque, rather than transparent film. As the discs 37 and 40 are opaque, the indicia on the underlying portions of discs 38 and 39 aligned with the windows 33 and 36 will not be visible.

By manually moving the exposed portions of the discs 37–40 within the windows 33–36, in the directions of the arrows indicated in FIG. 9, the days, months and years can be readily changed.

The drawings show the discs being bent or deformed to a generally L-shape in FIGS. 1–4 are deformed to a U-shape in FIGS. 8–10, but it is contemplated that the disc can be deformed to any non-planar shape. For example, the disc can be deformed so that the two sections are at an acute angle, or an obtuse angle, or the disc can be curved or coiled.

The indicia bearing device of the invention is an inexpensive yet reliable unit, that can be readily operated to expose the desired indicia through the openings or windows in the casing. As the flexible sheet or disc of film material is confined within the guideway over substantially its entire periphery, the disc can be rotated within the guideway without danger of jamming or kinking.

The device is a very compact unit due to the fact that the discs are folded or bent. The device is capable of exposing larger sized indicia for a given casing size than other types of display devices. Furthermore, the indicia, which is exposed through the window, is in a flat state which eliminates distortion of the indicia to the viewer.

The device can be fabricated with interior illumination, and by forming the guideways of transparent or translucent material, the exposed indicia will be uniformly lighted. In the case where illumination is not required, the unit can be formed with a relatively small depth.

Various modes of carrying out the invention are contemplated as being within the scope of the following claims particularly pointing out and distinctly claiming the subject matter which is regarded as the invention.

I claim:

1. An indicia bearing device, comprising an enclosure having a wall with a viewing opening, a narrow non-planar guideway disposed behind the wall, said guideway having a portion aligned with said viewing opening, a sheet of transparent flexible material disposed within the guideway and conforming to the non-planar contour of said guideway, indicia disposed on said sheet, and mounting means for mounting the sheet for rotation within the guideway, and illuminating means disposed within said enclosure, the portion of said guideway disposed in alignment with said opening being translucent whereby the light from said illuminating means will illuminate the indicia exposed within the opening, the sheet adapted to be rotated to expose the indicia through said viewing opening to a viewer.

2. The device of claim 1, wherein said sheet comprises a generally circular disc and said indicia is disposed in a circular pattern on the peripheral edge portion of said disc.

3. The device of claim 1, wherein said mounting means comprises a shaft connected to the guideway and disposed within a hole in said sheet, the axis of said shaft disposed at an angle to the axis of said opening.

4. The device of claim 1, wherein said sheet is formed of polyester film having a thickness in the range of 1 to 6 mils.

5. The device of claim 1, wherein the sheet is a laminated structure comprising two layers of plastic film bonded flatwise together, said indicia being disposed on an inner surface of one of said layers.

6. An indicia bearing device, comprising an enclosure having a wall with a viewing window, a non-planar guideway disposed within the enclosure and having a first portion aligned with said window and having a second portion disposed at an angle to said first portion, a disc-like sheet of flexible film disposed within the guideway and conforming to the non-planar contour of said guideway, mounting means for mounting the sheet for rotation about an axis, said axis extending across the second portion of said guideway, and indicia disposed on said disc-like sheet in a generally circular pattern about said axis, whereby the sheet can be rotated within the guideway to expose the indicia through said window to a viewer.

7. The device of claim 6, wherein said mounting means comprises a shaft connected to the guideway and disposed within a hole in said sheet, the axis of said shaft disposed at an angle to the axis of said window.

8. The device of claim 6, wherein said guideway has a generally U-shape configuration and the sheet is deformed to conform to said U-shape configuration.

9. An indicia bearing device, comprising an enclosure having a wall with a row of viewing windows, a non-planar guideway disposed within the enclosure behind the wall, said guideway having a generally straight first portion aligned with said row of windows and having a generally straight second portion disposed at an angle to said first portion, a disc-like sheet of flexible material associated with each window, said sheets disposed within the guideway and conforming to the non-planar contour of said guideway, mounting means for mounting each sheet for rotation about a separate axis, said axes being generally parallel and extending transversely of the second portion of said guideway, and indicia disposed on each sheet in a circular pattern about the axis of rotation of said sheet, whereby each sheet can be individually rotated to expose the indicia through the corresponding window.

10. The device of claim 9, wherein the peripheral portions of adjacent sheets are disposed in overlying relation.

11. The device of claim 10, wherein said device includes a pair of parallel guideways, a first of said disc-like sheets being disposed in one of said guideways and adjacent sheets being disposed in the other of said guideways, to reduce direct contact between the overlying peripheral portions of adjacent sheets.

12. An indicia-bearing device, comprising a core, an enclosure spaced outwardly of the core with the space between the enclosure and the core defining a non-planar guideway, a plurality of sheets of flexible indicia-bearing material disposed within the guideway, mounting means for separately mounting each sheet for rotation about an axis within the guideway, indicia disposed on each sheet in a generally circular pattern about the axis of said sheet, and a plurality of windows in said enclosure, each window being disposed in alignment with the pattern of indicia on one of said sheets, whereby each sheet can be rotated within said guideway to expose the indicia on said sheet through the respective window.

13. The device of claim 12, wherein the peripheral portions of adjacent sheets are in partially overlapping relation.

14. The device of claim 13, wherein the peripheral edge of one sheet travels, when rotated, in a path intersecting the window associated with an adjacent sheet and is disposed inwardly of said adjacent sheet, the portion of said adjacent sheet bearing said indicia being opaque so that the portion of the underlying first sheet aligned with said window is not visible.

15. An indicia bearing device, comprising an outer enclosure incuding a first wall, a back wall, a pair of opposed side walls and a pair of opposed end walls, a core spaced inwardly of the enclosure and including a front surface, a rear surface, a pair of opposed side surfaces and a pair of opposed end surfaces, the space between the walls of the enclosure and the corresponding surfaces of the core comprising a guideway, a pair of disc-like flexible sheets folded in a generally U-shaped pattern around the respective side surfaces of the core with a portion of each sheet overlying the front surface of the core, mounting means for mounting each sheet for rotation within the guideway about a separate axis, indicia disposed on each sheet in a generally circular pattern about the axis of rotation of said sheet, and a pair of windows disposed in the front wall of the enclosure in alignment with the pattern of indicia on the respective sheets, whereby each sheet can be individually rotated to expose the indicia through the respective window to a viewer.

16. The device of claim 15, and including a second pair of disc-like sheets of flexible material, said second sheets being disposed in generally U-shaped configuration around the end surfaces of the core, a portion of each second sheet disposed in overlying relation to the front surface of the core, second mounting means for mounting each second sheet for rotation within the guideway about a separate axis, second indicia disposed on each second sheet in a generally circular pattern about the axis of rotation of said sheet, and a pair of second windows disposed in the front wall of the enclosure and aligned with the pattern of indicia on the respective second sheets, whereby said second sheets can be individually rotated within the guideway to expose said second indicia through the respective window.

17. The device of claim 16, wherein the mounting means for each sheet comprises a pin extending between the back wall of the enclosure and the back surface of the core and extending through a hole in the respective sheet.

18. The device of claim 16, wherein peripheral portions of said second sheets underly said first sheets and are aligned with said first windows, the portion of the first sheets bearing the indicia being opaque so that the peripheral portions of the second sheets exposed through said first windows are not visible to the viewer.

19. An indicia bearing device, comprising an enclosure having a wall with a viewing opening, a narrow non-planar guideway disposed behind the wall, said guideway consisting of a first section aligned with said viewing opening and a second section disposed at approximately 90° with respect to said first section, a sheet of flexible material disposed within the guideway and conforming to the non-planar contour of said guideway, indicia disposed on said sheet, and mounting means for mounting the sheet for rotation within the guideway, the sheet adapted to be rotated to expose the indicia through said viewing opening to a viewer.

20. The device of claim 19, wherein said mounting means comprises a pivot shaft connected to the second section of the guideway and disposed within a hole in the sheet.

21. The device of claim 20, wherein the first section of said guideway is defined by said wall and a guide member disposed parallel to said wall, and said device includes second spacing means for spacing said guide member from said wall.

22. The device of claim 21, wherein said second spacing means comprises a plurality of spacers disposed on the surface of said guide member facing said wall and disposed outwardly of the periphery of the sheet.

23. The device of claim 19, wherein the second section of said guideway includes a pair of spaced guide walls, and said device includes first spacing means interconnecting said guide walls to maintain the walls a uniform distance apart.

24. The device of claim 23, wherein a shaft is connected to one of said guide walls and extends through a hole in said sheet and into an aperture in the other of said guide walls, and said first spacing means comprises an abutment on said shaft which engages the surface of said other guide wall.

25. An indicia bearing device, comprising a wall having a plurality of viewing openings, a narrow non-planar guideway disposed behind the wall, said guideway having a portion aligned with said viewing openings, a plurality of sheets of flexible material disposed within the guideway and conforming to the non-planar contour of said guideway, adjacent sheets being in partially overlapping relation, indicia disposed on each of said sheets and exposed through the respective openings, and mounting means for mounting the sheets for rotation within the guideway, said sheets being individually rotatable to expose the indicia on each sheet through the respective viewing opening to a viewer.

* * * * *

UNITED STATES PATENT AND TRADEMARK OFFICE

CERTIFICATE OF CORRECTION

PATENT NO. : 4,322,904
DATED : April 6, 1982
INVENTOR(S) : KENNETH J. MUDERLAK

It is certified that error appears in the above-identified patent and that said Letters Patent are hereby corrected as shown below:

Col. 1, line 16, Cancel "amounts" and substitute therefor ---amount---; Col. 6, line 28. Cancel "are" and substitute therefor ---and---; Col. 8, line 24, CLAIM 15, Cancel "first" and substitute therefor ---front---.

Signed and Sealed this

*Ninth* Day of *November 1982*

[SEAL]

*Attest:*

GERALD J. MOSSINGHOFF

*Attesting Officer* *Commissioner of Patents and Trademarks*